United States Patent [19]

Tang et al.

[11] 4,401,810

[45] Aug. 30, 1983

[54] METHOD OF STABILIZING FELTED CELLULOSIC SHEET MATERIAL WITH AN ALKALI METAL BOROHYDRIDE

[75] Inventors: Lucia C. Tang, Potomac, Md.; Margaret A. Troyer, Washington, D.C.

[73] Assignee: United States of America as represented by the Librarian of Congress, Washington, D.C.

[21] Appl. No.: 300,326

[22] Filed: Sep. 8, 1981

[51] Int. Cl.[3] ..... D21C 3/00

[52] U.S. Cl. ..... 536/56; 162/80; 162/181.1

[58] Field of Search ..... 8/107; 427/336; 162/80, 162/181.1; 536/56

[56] References Cited

U.S. PATENT DOCUMENTS 3,081,265 3/1963 Burr ..... 252/105
3,318,657 5/1967 Wade ..... 8/107 X

FOREIGN PATENT DOCUMENTS 610654 12/1960 Canada .
610655 12/1960 Canada .

*Primary Examiner*—Michael R. Lusignan
*Attorney, Agent, or Firm*—Joseph A. Hill; Thomas J. Byrnes; A. David Spevack

[57] ABSTRACT

Felted cellulosic sheet material is treated with a solution of an alkali metal borohydride in order to improve and stabilize its strength and brightness. A subsequent wash with deionized water or preferably an aqueous solution containing an alkaline earth metal hydroxide, carbonate, or bicarbonate further improves the stability of the brightness and strength of felted cellulosic sheet material. The washing of cellulosic sheet material is most efficiently accomplished in an apparatus providing a means to add a metered amount of alkaline earth metal hydroxide, carbonate, or bicarbonate to a continuously flowing stream of wash medium.

6 Claims, No Drawings

METHOD OF STABILIZING FELTED CELLULOSIC SHEET MATERIAL WITH AN ALKALI METAL BOROHYDRIDE

GOVERNMENT LICENSE

The invention described herein may be manufactured and used by or for the Government of the United States of America for governmental purposes without the payment of any royalties thereon or therefor.

BACKGROUND OF THE INVENTION

1. Field of the Invention

This invention relates to a method for improving and stabilizing the brightness and strength of felted cellulosic sheet material by treating the material with a solution of an alkali metal borohydride, and thereby retarding the type of deterioration which results in color formation in and embrittlement of the cellulosic material. The invention also contemplates improving the results obtained from the borohydride treatment by washing the material with a solution containing an alkaline earth metal hydroxide, carbonate, or bicarbonate. The invention further relates to an apparatus for efficiently washing the material in a continuously flowing stream of wash medium.

2. Prior Art

It is well known to investigators in the art that acidic paper or other felted cellulosic sheet material, having an initial pH of below 5.0, generally degrades rapidly. Such acidic cellulosic material becomes discolored and brittle and may have a useful life of only 30 to 80 years. In contrast, a similar paper of felted cellulosic material having an initial pH above 6.5 generally exhibits a slow rate of deterioration. Such neutral or slightly alkaline felted cellulosic material remains bright and flexible on natural aging. Machine-made paper produced since the early years of the 19th century is frequently acidic, with an initial pH value in the range of 4.5 to 5.5, because of the use of alum/rosin sizing used in its manufacture. Gaseous oxides of sulfur and nitrogen present as pollutants in urban atmospheres are absorbed by cellulosic materials and react with ambient moisture to form acids which cause further deterioration of these materials.

The stability of a material is reflected by the extent to which the original properties of the material are retained over time. A stable felted cellulosic sheet material will exhibit a low rate of change in properties such as brightness and strength as measured by folding endurance. It is established conservation practice to improve the brightness and strength stability of felted cellulosic sheet material by neutralizing acidity produced from internal sources created by the manufacturing procedures and deacidifying felted cellulosic sheet material by neutralizing existing acidity and incorporating into the material an alkaline reserve to neutralize acidity absorbed into cellulosic material over the course of time from external sources such as air pollutants.

In addition to the deterioration associated with the presence of acidity in paper, oxidative reactions are an important component of cellulose degradation, and may be manifested by color formation and embrittlement. Pulping and bleaching procedures used during the manufacture of felted cellulosic material may introduce oxidized groups along the cellulose molecule which groups, in turn, may be involved in color formation, chain scission, and depolymerization reactions. In particular carbonyl groups, especially those occurring at carbon atoms 2 and 3 of oxidized anhydroglucose units within the cellulose molecule, have been implicated in color reversion. Trace metals from machinery or from natural water sources may further act as oxidation catalysts in the resulting felted cellulosic material.

In aqueous solution, alkali metal borohydrides, particularly sodium and potassium borohydride, are moderate reducing agents which can selectively reduce carbonly compounds such as aldehydes and ketones to the corresponding alcohols, without reducing carboxylic acid groups. The alkali metal borohydrides also act as reducing agents with a variety of inorganic metal ions in aqueous solution.

William H. Rapson, in Canadian Pat. Nos. 610,654 and 610,655, both issued Dec. 13, 1960, proposes using sodium borohydride in processing cellulosic pulps, in order to increase the brightness and improve the brightness retention of such pulps. In Canadian Pat. No. 610,654, Rapson uses sodium borohydride as a supplemental treatment following chlorine dioxide bleaching of wood pulp. Rapson notes that while chlorine dioxide readily oxidizes lignin and resin, it does not react with the carbohydrate component of wood pulp. Thus, while chlorine dioxide does not introduce undesirable carbonyl groups into the cellulose fraction, neither does it oxidize nor thereby eliminate those carbonyl groups already present. The combination of chlorine dioxide followed by sodium borohydride is used by Rapson in order to produce a pulp of high whiteness and color stability, without the loss in pulp strength which would occur if a strong oxidizing bleach such as hypochlorite were used. In Canadian Pat. No. 610,655, Rapson used sodium borohydride treatment to increase the brightness and improve the color stability of wood pulp and of cotton linters. Rapson also reports that sodium borohydride treatment improves the color stability of cotton linters which have been bleached with sodium hypochlorite at pH 7. In both Canadian Pat. Nos. 610,654 and 610,655, Rapson only suggests that sodium borohydride treatments are useful during the processing of cellulosic pulps. Rapson does not suggest the present invention wherein alkali metal borohydride is adapted to successfully treat formed felted cellulosic sheet material, including aged papers.

Francis K. Burr, in U.S. Pat. No. 3,081,265, issued Mar. 12, 1963, proposes using an alkali metal borohydride as part of a detergent composition for washing cotton or rayon fabrics, in order to decrease the loss in strength of such woven fabrics after repeated washings. Burr suggests that the detergent composition is particurlarly effective for repeated washing of cotton or rayon fabrics in water containing iron, because the composition prevents the deposition onto the fabric of iron which otherwise would cause discoloration and contribute to lower strength. Burr only suggests that the incorporation of sodium borohydride in an aqueous solution of detergent is useful during repeated washings of woven cotton or rayon textile fabrics. Burr does not suggest the present invention wherein alkali metal borohydride is adapted to successfully brighten and strengthen nonwoven felted cellulosic sheet material such as paper.

Lucia C. Tang and Norvell M. M. Jones in the JOURNAL OF THE AMERICAN INSTITUTE FOR CONSERVATION, 18 (2), pp. 61–81 (1979), note that calcium ion in the wash water used in the conservation of paper materials improves the aging characteristics of such paper. Tang and Jones suggest introducing calcium ion into laboratory distilled or demineralized wash water by flowing the deionized water through a column of calcium carbonate. Tang and Jones do not attempt to control the quantity of calcium ion so introduced into the wash water.

OBJECTS OF THE INVENTION

The method of stabilizing felted cellulosic sheet materials, which is our invention, is intended to retard the deterioration of cellulosic sheet material by improving brightness and strength retention, improving flexibility, and reducing acidity, without causing any deleterious effects to any image borne by the felted cellulosic material.

It is therefore an object of this invention to stabilize the strength of felted cellulosic sheet material.

It is also an object of this invention to restore or improve the brightness and brightness stability of felted cellulosic material.

It is a further object of this invention to deacidify felted cellulosic sheet material.

An additional object of this invention is to provide an apparatus which efficiently washes felted cellulosic sheet material.

These and other objects of this invention become apparent in the following description.

SUMMARY OF THE INVENTION

By this invention, felted cellulosic sheet material such as formed paper sheets or paper artifacts, which may or may not have visible images thereon, is brightened and stabilized by a treatment comprising contacting the material for a time between 1 minute and 24 hours, preferably ¼ to 3 hours, and most perferably ½ to 1 hour, with a solution containing between 0.1 to 10 percent of an alkali metal borohydride, preferably sodium or potassium borohydride. Other compatible deacidification or auxiliary brightening agents such as are well known in the art, including sodium hydrosulfite, dilute calcium hydroxide, and the like, may be applied together with the alkali metal borohydride solution. The treatment can therefore include deacidification of the sheet material by known techniques along with the reductive stabilization by the method of this invention. The alkali metal borohydride may be dissolved in any solvent in which sodium or potassium borohydride is soluble and which solvent is not deleterious to cellulosic sheet material, or to the inks or paints used on paper or paper artifacts, or to the glues and materials used in binding paper sheet materials or artifacts. Such solvents include water, alkaline alcohol or alcohol-water mixtures, wherein the alcohols contain 1–4 carbon atoms, glycol ethers, and the like. Aqueous solutions are preferred. An aqueous solution containing 0.1 to 2 percent of an alkali metal borohydride is the more preferred solution used in the process of this invention. After treatment with the borohydride solution, the material can be dried, but it is preferred to wash the treated material with deionized water or more preferably with a wash solution containing a compound selected from the group consisting of an alkaline earth metal hydroxide, carbonate, and bicarbonate. The wash removes monovalent alkali metal ions from the treated cellulosic material. The wash may comprise the same solvent used to dissolve the alkali metal borohydride in the first treatment step. In the preferred embodiment, the wash is an aqueous solution containing between 5 and 1,500 parts-per-million (ppm) of an alkaline earth metal ion, preferably calcium or magnesium ion, from the corresponding hydroxide, carbonate, or bicarbonate.

The wash step of this process is most advantageously accomplished in a chemical feeder apparatus where the felted cellulosic sheet material is washed to remove the alkali metal ion in a continously flowing stream of solvent containing a metered amount of an alkaline earth metal ion from the corresponding hydroxide, carbonate, or bicarbonate. The washing apparatus comprises a tray with an inlet and an outlet. The inlet is fed by a inlet conduit, and the outlet is fed by an outlet conduit. The wash solvent, preferably deionized water, flows at a selected rate between 5 and 1000 ml/min., preferably between 10 and 400 ml/min., from the inlet to the outlet. A metering means is connected to the inlet conduit. This means feeds an amount of a divalent alkaline earth metal ion, preferably calcium or magnesium ion from the corresponding hydroxide, carbonate, or bicarbonate from a reservoir, into the inlet stream so as to maintain between 5 and 1500 ppm of the divalent alkaline earth metal ion in the inlet stream. The metering means can be connected by known means to a conductivity meter monitoring the inlet stream prior to entry of the inlet stream into the wash tray. The conductivity meter monitors the concentration of the alkaline earth metal ion in solution entering the wash tray and controls the metering means by known electronic instrumentation such that the concentration of the alkaline earth metal ion in solution is maintained at a predetermined level. If needed, the outlet solvent stream can be purified by known distillation and/or ion-exchange techniques and returned to the inlet conduit. Following the wash, done by any technique, the felted cellulosic material is dried by known techniques.

DESCRIPTION OF THE PREFERRED EMBODIMENTS

Now having described the method and apparatus of this invention in general terms, the following examples are set forth to more particularly illustrate the invention.

General Procedures

In carrying out the following examples, samples were placed between open mesh rubber matting and immersed in the treatment bath having the appropriate concentration of alkali metal borohydride. The matting was used to support and protect the treatment sample and to facilitate movement of the sample from the borohydride treatment zone to the washing apparatus. After treatment with the alkali metal borohydride, those samples to be washed and/or deacidified were processed in the chemical feeder apparatus described above, and all wetted samples were air-dried.

The brightening and the stabilization of felted cellulosic sheet material by the method of this invention are illustrated by comparison of treated sample papers to untreated control papers. The samples and controls are tested for the following properties:

(a) Brightness:

The brightness (directional reflectance at 457 nm) is measured using a Photovolt Model 670 reflection meter.

(b) Folding Endurance:

The MIT folding endurance is determined using ½ kg tension in the machine direction according to TAPPI Suggested Method T-511, 1969.

(c) pH:

A variation of the cold-extraction pH is measured, as described by G. B. Kelly, Jr., in ARCHIVES ET BIBLIOTHEQUES DE BELGIQUE 12, pp. 91–105 (1974). Using 2.50 g specimens pulped for 45 seconds in a Waring blender in a total of 250 ml deionized water, the pH is measured with a Fisher Accumet Model 320 pH meter and glass electrode standardized against a pH 7.00 buffer.

(d) Calcium, Sodium, and Boron Content:

The calcium, sodium, and boron content is determined using a direct solid sampling technique in conjunction with flameless atomic absorption spectroscopy (AAS), as described by L. C. Tang and M. A. Troyer at the 1981 PITTSBURGH CONFERENCE ON ANALYTICAL CHEMISTRY AND APPLIED SPECTROSCOPY, Paper No. 449, Mar. 11, 1981. A Varian Techtron AA-6 spectrophotometer is employed with a Model 90 carbon rod atomizer and a Model A-25 potentiometer recorder. The calcium content, determined by AAS as ppm Ca, may also be expressed as percent $CaCO_3$, even for those papers treated with calcium hydroxide or bicarbonate as these reagents are converted to the carbonate on air-drying of the treated sheets. For comparison purposes, the calcium content of papers of below pH 7.0 is also expressed here as "percent $CaCO_3$."

(e) Property Retention On Accelerated Aging:

Accelerated aging of experimental papers is effected using humid (90° C./50% R.H.) and dry (100° C.) circulating ovens. Prior to physical testing, experimental papers are conditioned according to TAPPI Official Standard T-402, 1970. Brightness, folding endurance, and pH are monitored at intervals throughout the duration of oven aging, as described above. The effects of the present invention on aging behavior are assessed in terms of the "relative improvement" in property retention, derived from the relative rates of change in a property over time (oven exposure) of the samples being compared. Brightness has been found to vary linearly with the duration of oven exposure, while the logarithm of folding endurance is used as the linearizing function for this property. From a linear plot, obtained by the method of least squares, the slope is computed. Dividing the slope found for a treated sample by that found for an untreated control yields a "relative rate" of property change, and the reciprocal of this value is then designated the "relative improvement" produced by the given procedure. Tests of statistical significance, using the estimated variance of the computed slopes, are applied to all samples, so that "relative improvement" is reported only when the differences between samples are statistically significant.

EXAMPLE 1

Champion Foldur Kraft paper taken from a single roll was cut into 8"×10" machine-long sheets. The Foldur Kraft paper is a bleached kraft paper made from 90-percent southern pine and 10-percent hardwood pulps, with 0.5-percent rosin size and 3.0-percent titanium dioxide filler. Foldur Kraft sheets were treated for ½ hour in either 0.01 percent, 0.1 percent, or 1.0 percent aqueous solutions of sodium borohydride. The treated samples, plus untreated Foldur Kraft controls, were then processed in one of the following ways: (1) left unwashed; (2) washed one hour in deionized water; or (3) washed one hour in dilute calcium hydroxide solution containing 11.2 ppm calcium, using the chemical feeder apparatus described above. The treated and/or washed sheets were allowed to air-dry. Samples of the experimental papers were then subjected to thermal accelerated aging in the humid (90° C./50% R.H.) and dry (100° C.) ovens for one, two, three, and five weeks. Brightness, folding endurance, and pH measurements were conducted on aged and unaged samples. The calcium, sodium, and boron content was also determined.

Summarized in Table 1 are the initial physical and chemical properties conferred to the experimental Foldur Kraft papers by the various treatment and/or washing procedures.

TABLE 1.

Initial Physical and Chemical Properties of Experimental Papers

FOLDUR KRAFT

| Treatment/Washing Procedure | INITIAL PROPERTIES Brightness | MIT Folding Endurance (½ kg) | pH | % $CaCO_3$ (from AAS) |
|---|---|---|---|---|
| Not Treated/Not Washed | 75.6 | 890 | 5.1 | 0.11 |
| Not Treated/DI | 75.6 | 1045 | 5.7 | 0.07 |
| Not Treated/11.2 ppm Ca | 75.0 | 1050 | 7.0 | 0.18 |
| 0.01% $NaBH_4$/Not Washed | 76.4 | 1255 | 6.4 | 0.09 |
| 0.01% $NaBH_4$/DI | 77.0 | 1325 | 6.2 | 0.12 |
| 0.01% $NaBH_4$/11.2 ppm Ca | 76.7 | 1285 | 7.2 | 0.17 |
| 0.1% $NaBH_4$/Not Washed | 77.7 | 960 | 9.0 | 0.10 |
| 0.1% $NaBH_4$/DI | 79.2 | 1065 | 7.5 | 0.11 |
| 0.1% $NaBH_4$/11.2 ppm Ca | 78.5 | 1345 | 7.6 | 0.18 |
| 1.0% $NaBH_4$/Not Washed | 79.2 | 20 | 9.5 | 0.04 |
| 1.0% $NaBH_4$/DI | 80.5 | 1370 | 7.9 | 0.04 |
| 1.0% $NaBH_4$/11.2 ppm Ca | 79.5 | 1030 | 7.7 | 0.19 |

DI—Deionized water.

TABLE 2.

Relative Sodium, Boron, and Calcium Content of Various Foldur Kraft Experimental Papers

| Treatment/Washing Procedure | Relative Na Content | Relative B Content | Relative Ca Content |
|---|---|---|---|
| Not Treated/Not Washed | 1.00 | 1.00 | 1.00 |
| Not Treated/DI | 0.19 | 0.94 | 0.66 |
| Not Treated/11.2 ppm Ca | 0.15 | 0.79 | 1.58 |
| 0.01% $NaBH_4$/Not Washed | 1.45 | 0.86 | 0.81 |
| 0.01% $NaBH_4$/DI | 0.88 | 0.91 | 1.04 |
| 0.01% $NaBH_4$/11.2 ppm Ca | 0.13 | 0.88 | 1.54 |
| 0.1% $NaBH_4$/Not Washed | 7.74 | 1.33 | 0.94 |
| 0.1% $NaBH_4$/DI | 2.21 | 0.94 | 0.96 |
| 0.1% $NaBH_4$/11.2 ppm Ca | 0.26 | 0.91 | 1.60 |
| 1.0% $NaBH_4$/Not Washed | 52.6 | 3.37 | 0.32 |
| 1.0% $NaBH_4$/DI | 3.56 | 1.21 | 0.51 |
| 1.0% $NaBH_4$/11.2 ppm Ca | 0.99 | 1.11 | 1.75 |

As is evident, the borohydride treatment produced increases in initial sample brightness of up to 5 brightness units, with the higher solution concentrations producing the greater brightening effect. Improved flexibility, as reflected in higher initial folding endurance, was imparted by all treatments, with the exception of the 1.0 percent $NaBH_4$/Not Washed procedure. It is theorized that the retention of crystalline reagent in these treated sheets was associated with embrittlement of the sample matrix and possible abrasion of the paper fibers during the folding test. The 11.2 ppm calcium wash was just sufficient to neutralize (pH 7.0) the untreated Foldur Kraft papers, although very little alkaline reserve was retained (0.18% $CaCO_3$). Owing to the alkalinity of the borohydride solutions (pH 9.5 to 10), treated sheets were alkalized to a greater or leser extent (pH 6.2 to 9.5) depending upon the concentration of the solution employed.

Table 2 compares the washing efficiency of a plain deionized water wash to a wash containing 11.2 ppm calcium. The results differ markedly in the amount of residual sodium removed from the sample sheets. It is theorized that due to ion exchange effects the calcium wash was able to remove sodium from the treated sheets to levels at or below those of the untreated, unwashed controls while the deionized water was not nearly as efficient. Both deionized water and the calcium washing solution removed boron from treated Foldur Kraft samples to levels at or below that of the control. It should also be noted that calcium is removed from Foldur Kraft paper in part by deionized water and substantially by the 1.0-percent borohydride treatment.

Tables 3 and 4, respectively, summarize the relative improvement in brightness and folding endurance retention on accelerated aging conferred by the various treatment procedures. All of the results were tested by standard statistical procedures to derive statistically significant (95 percent confidence interval) distinct groups which are set off by horizontal bars in the tables.

TABLE 3.

Relative Improvement in Brightness Retention Conferred by Various Sample Treatments

FOLDUR KRAFT

| Treatment/Washing Procedure | Initial Brightness | Initial Improvement in Brightness Retention On Accelerated Aging: Dry Oven | Humid Oven |
|---|---|---|---|
| Not Treated/Not Washed (Control) | 75.6 | 1.00 | 1.00 |
| Not Treated/11.2 ppm Ca | 75.0 | 2.02 | 1.34 |
| 0.01% $NaBH_4$/11.2 ppm Ca | 78.5 | 2.09 | 1.65 |
| 1.0% $NaBH_4$/11.2 ppm Ca | 79.5 | 2.18 | 2.30 |

TABLE 4.

Relative Improvement in Folding Endurance Retention Conferred by Various Sample Treatments

FOLDUR KRAFT

| Treatment/Washing Procedure | Initial MIT Folding Endurance (½ kg) | Relative Improvement in Folding Endurance Retention On Accelerated Aging: Dry Oven | Humid Oven |
|---|---|---|---|
| Not Treated/Not Washed | 890 | 1.00 | 1.00 |
| 0.01% $NaBH_4$/DI | 1325 | 3.20 | 2.51 |
| 0.01% $NaBH_4$/Not Washed | 1255 | 4.35 | 2.88 |
| 0.01% $NaBH_4$/11.2 ppm Ca | 1285 | 7.79 | 5.22 |
| Not Treated/11.2 ppm Ca | 1050 | 8.43 | 5.71 |
| 0.1% $NaBH_4$/11.2 ppm Ca | 1345 | 8.15 | 9.23 |
| 0.1% $NaBH_4$/DI | 1065 | 14.1 | 10.2 |
| 0.1% $NaBH_4$/Not Washed | 960 | 25.8 | 11.8 |
| 1.0% $NaBH_4$/DI | 1370 | 17.4 | 15.6 |
| 1.0% $NaBH_4$/11.2 ppm Ca | 1030 | 32.7 | 26.2 |

DI—Deionized water.

Of all the samples listed in Table 1, only those samples showing statistically significant improvement over the untreated, unwashed control papers are included in Tables 3 and 4. As shown in Table 3, all of the samples showing significant improvement in brightness retention had been washed with 11.2 ppm calcium. The 1.0-percent $NaBH_4$-treated samples showed significantly greater improvement in brightness retention than that conferred by calcium washing alone. As shown in Table 4, a 1.0-percent $NaBH_4$ solution treatment followed by 11.2 ppm Ca wash shows 25 to 30 times the folding endurance stability of the control and 4 times the stability of a Ca wash alone. Also, both 0.1-percent $NaBH_4$ treatment without a wash and a 1.0-percent $NaBH_4$ treatment with a deionized water wash showed significant improvement.

EXAMPLE 2

Newsprint paper from a single roll was cut into 8" by 10" machine-long sheets. The newsprint was made from about 80-percent groundwood and 20-percent unbleached sulfite pulp. Newsprint sheets were treated and aged and physical and chemical properties measured as specified in Example 1.

Table 5 lists the initial physical and chemical properties conferred to the experimental newsprint papers by the various treatment and/or washing procedures. For newsprint, the borohydride treatment produced increases in initial handsheet brightness of up to 10 brightness units. The decrease in brightness observed on calcium washing is typical of newsprint, but the combination of either 0.1-percent or 1.0-percent $NaBH_4$ treatment followed by 11.2 ppm Ca washing mitigated this effect. Improved flexibility, as reflected in higher initial folding endurance, was also imparted by the borohydride treatment with the higher solution concentrations producing the greater effect; again, the 1.0-percent $NaBH_4$/Not Washed procedure was exceptional in that these treated sheets demonstrated marked immediate embrittlement. Since newsprint is characterized by much greater "pick-up" than Foldur Kraft, the 11.2 ppm Ca wash was sufficient to raise the pH of untreated newsprint from 5.2 to 8.8, with the retention of 0.47-percent $CaCO_3$.

TABLE 5.

Initial Physical and Chemical Properties of Experimental Papers

NEWSPRINT

| Treatment/Washing Procedure | INITIAL PROPERTIES: Brightness | MIT Folding Endurance (½ kg) | pH | % $CaCO_3$ (from AAS) |
|---|---|---|---|---|
| Not Treated/Not Washed | 56.6 | 340 | 5.2 | 0.21 |
| Not Treated/DI | 56.2 | 400 | 5.9 | 0.18 |
| Not Treated/11.2 ppm Ca | 51.9 | 450 | 8.8 | 0.47 |
| 0.01% $NaBH_4$/Not Washed | 57.3 | 460 | 7.1 | 0.26 |
| 0.01% $NaBH_4$/DI | 57.9 | 540 | 5.5 | 0.22 |
| 0.01% $NaBH_4$/11.2 ppm Ca | 52.4 | 480 | 8.0 | 0.39 |
| 0.1% $NaBH_4$/Not Washed | 60.6 | 560 | 8.8 | 0.14 |
| 0.1% $NaBH_4$/DI | 62.6 | 595 | 7.2 | 0.17 |
| 0.1% $NaBH_4$/11.2 ppm Ca | 59.1 | 525 | 7.9 | 0.47 |
| 1.0% $NaBH_4$/Not Washed | 61.6 | 10 | 9.2 | 0.07 |
| 1.0% $NaBH_4$/DI | 66.2 | 600 | 8.0 | 0.05 |
| 1.0% $NaBH_4$/11.2 ppm Ca | 62.3 | 600 | 8.5 | 0.53 |

DI—Deionized Water

TABLE 6.

Relative Sodium, Boron, and Calcium Content of Various Newsprint Experimental Papers

| Treatment/Washing Procedure | Relative Na Content | Relative B Content | Relative Ca Content |
|---|---|---|---|
| Not Treated/Not Washed | 1.00 | 1.00 | 1.00 |
| Not Treated/DI | 0.21 | 0.99 | 0.84 |
| Not Treated/11.2 ppm Ca | 0.14 | 0.95 | 2.23 |
| 0.01% $NaBH_4$/Not Washed | 5.50 | 1.11 | 1.25 |
| 0.01% $NaBH_4$/DI | 1.82 | 1.20 | 1.04 |
| 0.01% $NaBH_4$/11.2 ppm Ca | 0.13 | 1.23 | 1.85 |
| 0.1% $NaBH_4$/Not Washed | 18.1 | 1.46 | 0.69 |

TABLE 6.-continued

Relative Sodium, Boron, and Calcium Content of Various Newsprint Experimental Papers

| Treatment/Washing Procedure | Relative Na Content | Relative B Content | Relative Ca Content |
|---|---|---|---|
| 0.1% $NaBH_4$/DI | 6.36 | 1.38 | 0.79 |
| 0.1% $NaBH_4$/11.2 ppm Ca | 0.24 | 1.26 | 2.21 |
| 1.0% $NaBH_4$/Not Washed | 60.5 | 5.75 | 0.31 |
| 1.0% $NaBH_4$/DI | 11.7 | 1.76 | 0.24 |
| 1.0% $NaBH_4$/11.2 ppm Ca | 1.12 | 1.20 | 2.53 |

Table 6 summarizes the relative sodium, boron, and calcium contents of the various newsprint experimental papers. Again, the 11.2 ppm calcium wash was able to remove residual sodium from the treated sheets to levels at or below those of untreated, unwashed newsprint controls; while the deionized water was not nearly as efficient. Also, it should be noted that calcium was substantially removed from newsprint paper by the 1.0-percent $NaBH_4$ treatment.

Tables 7 and 8, respectively, summarize the relative improvement in brightness and folding endurance retention on accelerated aging conferred to newsprint paper by the various treatment procedures. The results are displayed in the same manner as for the Foldur Kraft results summarized in Tables 3 and 4. As shown in Table 7, all of the samples showing significant improvement in brightness retention had been washed with 11.2 ppm calcium. The 0.01-percent and 0.1-percent $NaBH_4$ treatment of newsprint produced greater absolute brightness than did calcium washing alone, but these groups were statistically indistinguishable in their overall improvement in brightness retention on accelerated aging. As shown in Table 8, treatment with either a 0.1-percent or 1.0-percent $NaBH_4$ solution followed by a 11.2 ppm Ca wash produced about $3\frac{1}{2}$ to 4 times the folding endurance stability of the control and about $1\frac{1}{2}$ times the stability of a Ca wash alone.

EXAMPLE 3

The highly encouraging results of Example 1 contained with 1.0-percent $NaBH_4$ treatment of Foldur Kraft papers, followed by 11.2 ppm Ca washing, were reproduced and compared to the improvement conferred by simple deacidification. The comparison was made to ascertain whether noticeable benefits of the borohydride treatment were due merely to its alkalinity. Foldur Kraft sheets were treated $\frac{1}{2}$ hour in 1.0-percent aqueous sodium borohydride.

TABLE 7.

Relative Improvement in Brightness Retention Conferred by Various Sample Treatments

NEWSPRINT

| Treatment/Washing Procedure | Initial Brightness | Initial Improvement in Brightness Retention On Accelerated Aging: Dry Oven | Humid Oven |
|---|---|---|---|
| Not Treated/Not Washed | 56.6 | 1.00 | 1.00 |
| Not Treated/11.2 ppm Ca | 51.9 | 1.55 | 1.51 |
| 0.01% $NaBH_4$/11.2 ppm Ca | 52.4 | 1.49 | 1.65 |
| 0.1% $NaBH_4$/11.2 ppm Ca | 59.1 | 1.24 | 1.66 |

TABLE 8.

Relative Improvement in Folding Endurance Retention Conferred by Various Sample Treatments

NEWSPRINT

| Treatment/Washing Procedure | Initial MIT Folding Endurance ($\frac{1}{2}$ kg) | Relative Improvement in Folding Endurance Retention On Accelerated Aging: Dry Oven | Humid Oven |
|---|---|---|---|
| Not Treated/Not Washed | 340 | 1.00 | 1.00 |
| 0.01% $NaBH_4$/DI | 540 | 1.54 | 1.84 |
| 0.01% $NaBH_4$/Not Washed | 460 | 1.97 | 1.89 |
| 1.0% $NaBH_4$/DI | 600 | 4.07 | 1.57 |
| 0.1% $NaBH_4$/DI | 595 | 3.64 | 1.95 |
| 0.1% $NaBH_4$/Not Washed | 560 | 2.53 | 2.62 |
| Not Treated/11.2 ppm Ca | 450 | 2.68 | 2.63 |
| 0.01% $NaBH_4$/11.2 ppm Ca | 480 | 2.57 | 3.63 |
| 1.0% $NaBH_4$/11.2 ppm Ca | 600 | 3.87 | 3.36 |
| 0.1% $NaBH_4$/11.2 ppm Ca | 525 | 3.48 | 4.32 |

DI—Deionized water

The treated samples, plus untreated controls, were then washed in dilute aqueous calcium hydroxide solutions containing either 12 ppm Ca for neutralization or 40 ppm Ca for simple deacidification and air-dried. The samples were then treated and aged, and physical and chemical properties measured as specified in Example 1.

Table 9 shows the initial physical and chemical properties conferred to the experimental Foldur Kraft papers by the various treatments and/or washing procedures. The borohydride treatment produced some increase in initial sample brightness. All of the aqueous treatments improved flexibility (higher initial folding endurance). The 12 ppm Ca wash was again just sufficient to neutralize (pH 7.0) the untreated Foldur Kraft papers, with 0.23-percent $CaCO_3$ retained. The 40 ppm Ca wash was sufficient to raise the pH of untreated Foldur Kraft paper from 5.0 to 8.2, with the retention of 0.3-percent $CaCO_3$.

Tables 10 and 11, record, respectively, the relative improvement in brightness and folding endurance retention on accelerated aging conferred to Foldur Kraft paper by the various experimental procedures. As shown in Table 10, brightness retention was significantly improved by neutralization (12 ppm Ca) and deacidification (40 ppm Ca) compared to the controls. However, the difference in brightness retention for the two Ca concentrations was statistically insignificant. Prior treatment with borohydride solution significantly improved brightness retention at both levels of Ca washing, and again the difference in brightness retention for the two Ca concentrations was statistically insignificant. From these results, it is concluded that the borohydride treatment improves brightness retention for reasons other than its ability to alkalize the sample.

As shown in Table 11, all treatments and washes produced significant improvement in folding endurance retention after accelerated aging compared to the controls.

TABLE 9.

Initial Physical and Chemical Properties of Experimental Papers

FOLDUR KRAFT

| Treatment/Washing Procedure | INITIAL PROPERTIES Bright-ness | MIT Folding Endurance (½ kg) | | % $CaCO_3$ (from AAS) |
|---|---|---|---|---|
| Not Treated/Not Washed | 75.4 | 1075 | 5.0 | 0.12 |
| Not Treated/12 ppm Ca | 75.4 | 1430 | 7.0 | 0.23 |
| Not Treated/40 ppm Ca | 74.8 | 1350 | 8.2 | 0.37 |
| 1.0% $NaBH_4$/12 ppm Ca | 78.5 | 1500 | 7.4 | 0.23 |
| 1.0% $NaBH_4$/40 ppm Ca | 78.1 | 1325 | 8.7 | 0.31 |

TABLE 10.

Relative Improvement in Brightness Retention Conferred by Various Sample Treatments

FOLDUR KRAFT

| Treatment/Washing Procedure | Initial Brightness | Relative Improvement in Brightness Retention On Accelerated Aging: Dry Oven | Humid Oven |
|---|---|---|---|
| Not Treated/Not Washed | 75.4 | 1.00 | 1.00 |
| Not Treated/12 ppm Ca | 75.4 | 1.68 | 1.42 |
| Not Treated/40 ppm Ca | 74.8 | 1.99 | 1.50 |
| 1.0% $NaBH_4$/12 ppm Ca | 78.5 | 2.43 | 2.24 |
| 1.0% $NaBH_4$/40 ppm Ca | 78.1 | 2.41 | 2.39 |

TABLE 11.

Relative Improvement in Folding Endurance Retention Conferred by Various Sample Treatments

FOLDUR KRAFT

| Treatment/Washing Procedure | Initial MIT Folding Endurance (½ kg) | Relative Improvement in Folding Endurance Retention On Accelerated Aging: Dry Oven | Humid Oven |
|---|---|---|---|
| Not Treated/Not Washed | 1075 | 1.00 | 1.00 |
| Not Treated/12 ppm Ca | 1430 | 12.3 | 8.27 |
| Not Treated/40 ppm Ca | 1350 | 12.1 | 11.1 |
| 1.0% $NaBH_4$/12 ppm Ca | 1500 | 21.5 | 22.5 |
| 1.0% $NaBH_4$/40 ppm Ca | 1325 | 23.6 | 22.2 |

Treatment with $NaBH_4$ solution followed by either a neutralization wash (12 ppm Ca) or a deacidification wash (40 ppm Ca) shows 22 to 24 times the folding endurance stability of the control and 2 to 2½ times the stability of a Ca wash alone at either concentration. The differences in Ca ion concentration showed no significant difference in results.

EXAMPLE 4

The effects of sample pre-aging on the extent of improvement produced by subsequent washing, deacidification and/or sodium borohydride treatment were evaluated. In particular, it was desirable to ascertain whether or not sodium borohydride treatment could stabilize and/or restore the physical properties of partially degraded paper. Foldur Kraft sheets were either pre-aged 14 hours in the dry oven (100° C.) or pre-aged 7 hours in the humid oven (90° C./50% R.H.). Pre-aged sample sheets were treated ½ hour in 1-percent aqueous sodium borohydride. The treated samples, plus untreated pre-aged controls, were then washed in dilute calcium hydroxide solutions containing either 12 ppm or 40 ppm calcium, and air-dried. The use of 40 ppm Ca is considered deacidification. The samples were treated aged, and physical and chemical properties measured as specified in Example 1.

Table 12 shows the initial physical and chemical properties conferred to the pre-aged Foldur Kraft papers by the various treatment and/or washing procedures. The borohydride treatment fully restored and in fact increased the initial sample brightness. Sample flexibility, as reflected in initial folding endurance, was partially restored by all of the aqueous treatments, with the borohydride treatments producing slightly greater restoration of folding endurance than washing/deacidification alone. The 12 ppm Ca wash was slightly more than sufficient to neutralize the untreated pre-aged Foldur Kraft papers, conferring a final handsheet pH of 7.1 to 7.3, with 0.22-percent $CaCO_3$ retained. Likewise, the 40 ppm Ca wash was sufficient to raise the pH of untreated pre-aged Foldur Kraft papers from 5.0 to 8.1 to 8.3, with the retention of 0.37-percent to 0.43-percent $CaCO_3$.

TABLE 12.

Initial Physical and Chemical Properties of Experimental Papers

PRE-AGED FOLDUR KRAFT

| Treatment/Washing Procedure | INITIAL PROPERTIES Brightness: Pre-Aged Dry Oven | Pre-Aged Humid Oven | MIT Folding Endurance (½ kg): Pre-Aged Dry Oven | Pre-Aged Humid Oven | pH: Pre-Aged Dry Oven | Pre-Aged Humid Oven | % $CaCO_3$(from AAS): Pre-Aged Dry Oven | Pre-Aged Humid Oven |
|---|---|---|---|---|---|---|---|---|
| Not Treated/Not Washed | 74.7 | 74.1 | 660 | 740 | 5.0 | 5.0 | 0.10 | 0.10 |
| Not Treated/12 ppm Ca | 74.9 | 74.5 | 845 | 925 | 7.1 | 7.3 | 0.22 | 0.22 |
| Not Treated/40 ppm Ca | 74.2 | 74.0 | 915 | 1000 | 8.1 | 8.3 | 0.37 | 0.43 |
| 1.0% $NaBH_4$/12 ppm Ca | 78.7 | 78.7 | 930 | 1030 | 7.4 | 8.0 | 0.24 | 0.23 |
| 1.0% $NaBH_4$/40 ppm Ca | 78.7 | 78.2 | 995 | 1005 | 8.6 | 8.8 | 0.33 | 0.35 |

The "pick-up" of calcium was slightly greater in the pre-aged sheets than in the "fresh" Foldur Kraft samples of Example 3 above.

Tables 13 and 14, record, respectively, the relative improvement in brightness and folding endurance retention on accelerated aging conferred to pre-aged Foldur Kraft papers by the various experimental procedures. Significant improvement in brightness retention was acheived only by the borohydride treatment/calcium wash combinations for the pre-aged Foldur Kraft samples relative to the controls. Unlike the "fresh" Foldur Kraft of Example 3 above, the pre-aged paper did not benefit from calcium washing/deacidification alone, as far as brightness retention was concerned. Of the borohydride-treated pre-aged samples, no significant difference in brightness retention was observed between those papers washed with 12 ppm and with 40 ppm calcium. As shown in Table 14, all treatment procedures produced significant improvement in folding endurance retention on accelerated aging relative to the controls. Treatment with $NaBH_4$ solution followed by either a neutralization wash (12 ppm Ca) or a deacidification wash (40 ppm Ca) shows 20 to 30 times the folding endurance stability of the control and 2 to $2\frac{1}{2}$ times the stability of the Ca wash alone at either concentration. The differences in Ca ion concentration showed no significant differences in results.

As amply illustrated above, alkali metal borohydride treatment followed by efficient washing and/or alkalization is of substantial benefit in improving the initial brightness and in stabilizing the brightness and folding endurance on aging of felted cellulosic materials as well as restoring aged felted cellulosic material. The foregoing detailed description is to be understood as given by way of illustration and example only. The spirit and scope of this invention is limited solely to the appended claims.

TABLE 13.

Relative Improvement in Brightness Retention Conferred by Various Sample Treatments

PRE-AGED FOLDUR KRAFT

| Treatment/Washing Procedure | Initial Brightness Pre-Aged Dry Oven | Initial Brightness Pre-Aged Humid Oven | Relative Improvement in Brightness Retention On Accelerated Aging Dry Oven | Relative Improvement in Brightness Retention On Accelerated Aging Humid Oven |
|---|---|---|---|---|
| Not Treated/Not Washed | 74.7 | 74.1 | 1.00 | 1.00 |
| 1.0% $NaBH_4$/12 ppm Ca | 78.7 | 78.7 | 2.87 | 2.20 |
| 1.0% $NaBH_4$/40 ppm Ca | 78.7 | 78.2 | 2.82 | 2.26 |

TABLE 14.

Relative Improvement in Folding Endurance Retention Conferred by Various Sample Treatments

PRE-AGED FOLDUR KRAFT

| Treatment/Washing Procedure | Initial MIT Folding Endurance ($\frac{1}{2}$ kg) Pre-Aged Dry Oven | Initial MIT Folding Endurance ($\frac{1}{2}$ kg) Pre-Aged Humid Oven | Relative Improvement in Endurance Retention On Accelerated Aging Dry Oven | Relative Improvement in Endurance Retention On Accelerated Aging Humid Oven |
|---|---|---|---|---|
| Not Treated/Not Washed | 660 | 740 | 1.00 | 1.00 |
| Not Treated/12 ppm Ca | 845 | 925 | 11.5 | 13.0 |
| Not Treated/40 ppm Ca | 915 | 1000 | 11.2 | 12.8 |
| 1.0% $NaBH_4$/12 ppm Ca | 930 | 1030 | 23.3 | 26.1 |
| 1.0% $NaBH_4$/40 ppm Ca | 995 | 1005 | 18.5 | 34.0 |

What we claim is:

1. A method of stabilizing and brightening felted cellulosic sheet material by contacting said sheet material with a solution containing between 0.1 to 10 percent of an alkali metal borohydride, washing said sheet material in a wash of the solvent of said solution wherein the wash contains between 5 and 1500 ppm of a compound selected from the group consisting of an alkaline earth metal hydroxide, alkaline earth metal carbonate, and alkaline earth metal bicarbonate and subsequently drying said sheet material.

2. A method according to claim 1 wherein the alkali metal borohydride is selected from the group consisting of sodium borohydride and potassium borohydride.

3. A method according to claim 1 wherein the solution is an aqueous solution.

4. A method according to claim 3 wherein the alkaline earth metal is selected from the group consisting of calcium and magnesium.

5. A method according to claim 2 wherein said sheet material is contacted with an aqueous solution containing between 0.1- and 2-percent sodium borohydride, washed with a deionized water wash wherein said wash contains between 5 and 1500 ppm of a compound selected from the group consisting of an alkaline earth metal hydroxide, alkaline earth metal carbonate, and alkaline earth metal bicarbonate and dried.

6. A method according to claim 5 wherein the alkaline earth metal is selected from the group consisting of calcium and magnesium.

* * * * *